US007607738B2

(12) United States Patent
Gregory et al.

(10) Patent No.: US 7,607,738 B2
(45) Date of Patent: Oct. 27, 2009

(54) CONTOURED SEAT AND METHOD

(76) Inventors: Matthew Wayne Gregory, 112 Mark Twain Ct., Mt. Holly, NC (US) 28120; Marshall Dean Gaddis, 307 Forest Bay Ct., Belmont, NC (US) 28012

( * ) Notice: Subject to any disclaimer, the term of this patent is extended or adjusted under 35 U.S.C. 154(b) by 0 days.

(21) Appl. No.: 11/532,143

(22) Filed: Sep. 15, 2006

(65) Prior Publication Data

US 2007/0057562 A1 Mar. 15, 2007

Related U.S. Application Data

(60) Provisional application No. 60/717,408, filed on Sep. 15, 2005.

(51) Int. Cl.
*A47C 7/02* (2006.01)

(52) U.S. Cl. ..... 297/452.23

(58) Field of Classification Search ..... 297/452.21, 297/452.23, 452.25, 452.41, 452.24, 452.26, 297/452.27, 452.28, 230.13, 228.12; 5/648
See application file for complete search history.

(56) References Cited

U.S. PATENT DOCUMENTS 4,457,032 A * 7/1984 Clarke ..... 297/219.1
4,718,272 A * 1/1988 Plapp ..... 73/118.1
4,718,727 A * 1/1988 Sheppard ..... 297/452.26
4,912,788 A * 4/1990 Lonardo ..... 5/653
5,018,790 A * 5/1991 Jay ..... 297/452.26
5,294,181 A * 3/1994 Rose et al. ..... 297/452.25
5,402,545 A * 4/1995 Jolley ..... 5/653
5,437,497 A * 8/1995 Hutson ..... 297/338
5,746,465 A * 5/1998 Jones et al. ..... 296/65.03
5,868,463 A * 2/1999 MacKenzie et al. .... 297/228.12
5,887,951 A * 3/1999 Willingham ..... 297/452.23
6,135,550 A * 10/2000 Tucho ..... 297/199
6,250,719 B1 * 6/2001 Gebhardt ..... 297/452.48
7,044,547 B2 * 5/2006 Sorrenti ..... 297/250.1
2006/0170274 A1 * 8/2006 Moule ..... 297/452.25

* cited by examiner

*Primary Examiner*—Milton Nelson, Jr.
(74) *Attorney, Agent, or Firm*—Alston & Bird LLP

(57) ABSTRACT

A contoured seat generally includes a seat surface for supporting the thighs and buttocks of a sitter and a back surface for supporting the lower back of a sitter. Defined by the seat surface are a pair of bilateral, spaced protrusions that are positioned to extend into performs musculature of the sitter. Preferably, the seat surface is inclined at a 5° to 15°, and more preferably a 7.5°, angle to induce forward pelvic tilt in conjunction with lower lumbar support of a forward angle of the back surface. The seat and back surfaces may define a sacral-coccyx pocket that has a depth that varies, along its proximal-distal path to allow for sacral stabilization. The sacral-coccyx pocket preferably is relatively narrow and deep proximally and flares as it extends in the distal direction. A reinforcing ridge may extend across a top edge of the sacral-coccyx pocket to provide additional support.

25 Claims, 9 Drawing Sheets

CONTOURED SEAT AND METHOD

CROSS-REFERENCE TO RELATED APPLICATIONS

This application claims the benefit of U.S. Provisional Patent Application No. 60/717,408, filed Sep. 15, 2005, which is incorporated herein by reference in its entirety.

BACKGROUND OF THE INVENTION

1. Field of the Invention

The present invention is related to orthopedic supports, and in particular supportive seats that seek to mediate or avoid orthopedic injuries.

2. Description of Related Art

Lower back injuries (chronic and acute) are a massive problem in the United States, leading to significant economic costs due to the expense of treatment and the lost productivity of workers. These injuries are especially prevalent in workers that have intermittent labor duties between which they spend long times in a seated position. For example, truck drivers oftentimes spend eight or more hours per day seated during driving and then must immediately begin unloading upon reaching a destination. This not only causes back injuries, but also exacerbates existing chronic and acute injuries.

One possible solution for chronic lower back injuries is to seek chiropractic or other medical care on a repeated basis during which adjustments are made to the spine to place it in a more normal (anatomic) posture that reduces pain and maintains flexibility. However, time is not always available for such appointments and the adjustments need to be maintained in between appointments. Therefore, efforts have been made to promote the use of various furniture and devices that maintain correct anatomical posture while seated.

For example, U.S. Pat. No. 3,138,404 to Newton (the '404 patent) discloses a body support for use with cushioned seats. The body support is constructed of a molded plastic sheet that is stiff, but still with some flexibility, and that can be placed onto an existing padded seat to provide firmer, additional support. It includes a cup-shaped body 10 having back 11 and leg portions 12, as shown in FIGS. 1-5 of the '404 patent. The back portion 11 supports the small of the back. Sides 15 of the body 10 support the hips and the leg support portion 12 supports the thighs.

Portions 16 connecting the sides 15 with the top of the back portion are rounded. In addition, portions 17 of the periphery between the sides 15 and the front of the leg support portion 12 are rounded. Ostensibly, the rounded shapes avoid formation of pressure points. An arcuate concave relief portion 18 in the center of the back portion 11 extends down to the rear of the leg portion 12. Ostensibly, this relieves pressure on the coccyx without increasing strain on the other parts of the body.

Despite the advantages provided by the '404 patent over non-contoured, cushioned seats, improvements in the support provided by portable and other seats are always desired. In particular, seats that provide and promote stable posture at balanced anatomic positions are desirable to mediate and avoid acute and chronic lower back injuries.

BRIEF SUMMARY OF THE INVENTION

The above needs are addressed and other advantages achieved by providing a contoured seat system or orthotic of the present invention. The contoured seat generally includes a seat surface for supporting the thighs and buttocks of a sitter and a back surface for supporting the lower back of a sitter. Defined by the seat surface are a pair of bilateral, spaced protrusions that are positioned to extend into piriformis musculature of the sitter. For example, the protrusions may be ovals, knobs, or plateaus that are constructed of a stiff material or a gel material to provide comfortable pressure to the piriformis area. Preferably, the seat surface is inclined at an angle of 5° to 15°, and more preferably at an angle of 7.5°, to induce forward pelvic tilt in conjunction with lower lumbar support of a forward angle of the back surface. As another option, the seat and back surfaces may define a sacral-coccyx pocket that has a depth that varies, such as from about ½ inch to 2 inches, along its proximal-distal path to allow for sacral stabilization. The sacral-coccyx pocket preferably is relatively narrow and deep proximally and flares as it extend in the distal direction. The width of the sacral-coccyx pocket varies from about 1½ inches to 2 inches. Advantageously, the depth of the sacral-coccyx groove removes pressure and tension from the sacrum and coccyx and yet still leaves enough room for support of the buttocks and gluteus region. A reinforcing ridge may extend across a top edge of the sacral-coccyx pocket to provide additional support, while the remainder of the pocket may be formed of stiff but flexible material to pinch (e.g., a bilateral force) or stabilize the musculature around the lower lumbar spine and stabilize the sacroiliac (SI) joint.

The contoured seat and method of the present invention has many advantages. Providing specifically angled support surfaces (due to the angle of inclination of the surfaces) aligns the pelvis and lumbar spine as well as reduces pressure on the sacrum and coccyx. Generally, these support surfaces ensure that the pelvis is positioned at about a 15° angle and that the lumbar lordosis is maintained at about a 60° angle. The piriformis supporting ovals apply pressure to the difficult to stretch piriformis musculature. Overall, these positions reduce muscle tension and strain and reverse the incorrect rearward pelvic tilt of conventional ergonomic seating systems. For example, the shapes defined by the seating surface and back surface reduce muscle tension in the lower back when tested with surface dwelling electromyography (EMG) electrodes. In addition, x-ray testing reveals an increase in lordosis in the lumbar spine. These changes result in less fatigue and pain for the user.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
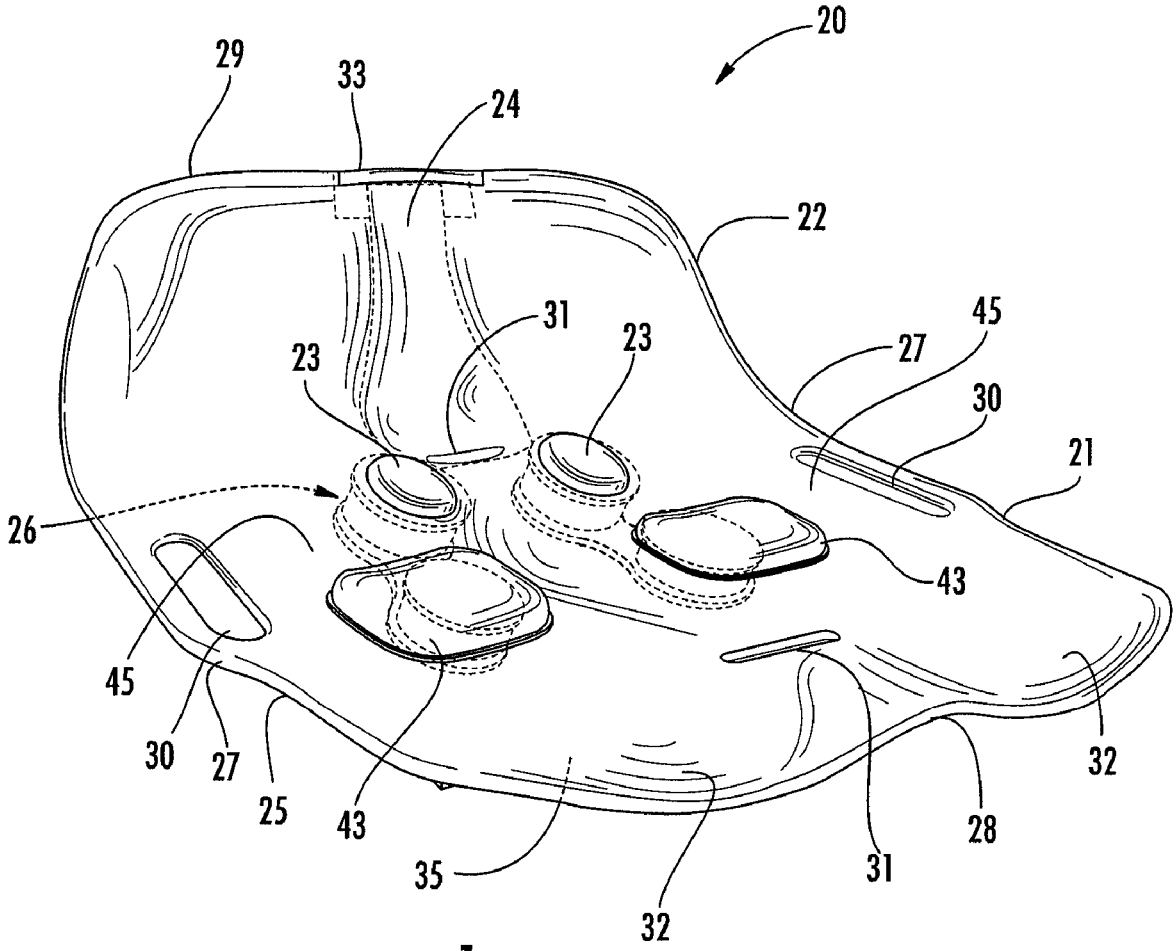
FIG. 1 is a perspective view of a contoured seat of one embodiment of the present invention.

Generally, the present invention includes a contoured seat 20 or orthotic having a seat surface 21 and a back surface 22 extending at an angle from the seat surface, as shown in FIG. 1. Defined in the seat surface 21 is a pair of spaced mounds or protrusions, such as a pair of ovals 23 of the illustrated embodiment, extending upwards from the seat surface at areas configured to extend into the piriformis muscles of a sitter. In addition, the contoured seat 20 may include a deep sacrum and coccyx pocket 24 defined in the back portion. Advantageously, these and other aspects of the contoured seat 20 provide for comfortable and anatomically supportive seating.

In the illustrated embodiment, the seat surface 21 and the back surface 22 are defined by a sheet 25 of plastic or other stiff, but still preferably somewhat flexible, material supported by shock absorber system 26. Sheet 25 can be formed, for example, through a molding procedure, using a thermoplastic material, such as injection molding, or through a machining process. In another aspect, 3/32 inch thick mat fiberglass may be employed for the sheet 25, allowing up to 250 to 300 lbs. of loading. It should be noted that other materials may be employed to define the surfaces 21 and 22, such as metals, wood and combinations of materials, and still be within the purview of the present invention. Further, various types of finishes, such as a sealant or a carbon fiber resin, can be applied to sheet 25.

Advantageously, embodiments of the present invention can provide a low-cost, compact, portable product. For example, existing prototypes weigh less than two pounds. As such, the contoured seat 20 may be taken and placed on vehicle seats, stadium seats, theater seats, recliners, hard surfaces, office seats, bleacher seats, cockpit seats, etc. Contoured seat 20 may either rest on such existing seats or surfaces, or may be attached to existing seats or surfaces, as described in more detail below.

Without being limited or dictated by theory, the contoured seat 20 of the present invention was developed in the context of several observations or theories of the inventor. Sacral rotation is one of the most common misalignments seen at chiropractic and medical offices. It is a common cause for most lower back (which includes the SI joint) problems including lumbar spasm, piriformis syndrome, facet joint dysfunction, and even lumbar disc bulging, herniation, or degeneration.

The piriformis muscles, which generally extend between the greater trochanter and sacral apex, are often associated with various back problems resulting from excess sacral rotation. The piriformis muscles are also very tough muscles to stretch and most persons do not stretch them properly without proper training or therapy. In addition, the muscles around the lower spine and sacrum are subject to strain and fatigue when unsupported. This can also lead to back pain or improper back alignment. Generally, therefore, reducing muscle work in the lower back region reduces strain and the incidence of injury or pain. Further, the hamstrings and gluteus muscles suffer from poor circulation during sitting due to pressure on the same.

An ideal angle for supporting the spine in lordosis and for pelvic tilt is about 7.5°. This angle is based on dividing 60° by a whole number such as eight. In nature and in engineering, 60° is considered to be a stable angle for structural support. For example, carbon molecules bind at 60° angles and the self-supporting equilateral triangle has 60° angles. The 60° angle and corresponding structure of the equilateral triangle provide for an even distribution of pressure and forces.

Seating designs that primarily focus on reducing pressure points attempt to distribute the weight of the sitter more evenly across the buttocks. However, this induces a pelvic tilt angle that reverses in direction, thus decreasing the lordotic curvature and increasing the tension in the lumbar spine. Another method of increasing lordotic curvature is by applying a back support vertically to the lumbar spine. This may increase lordosis, but it also increases discal pressure and tension on the lumbar paravertebral musculature.

Figure 2:
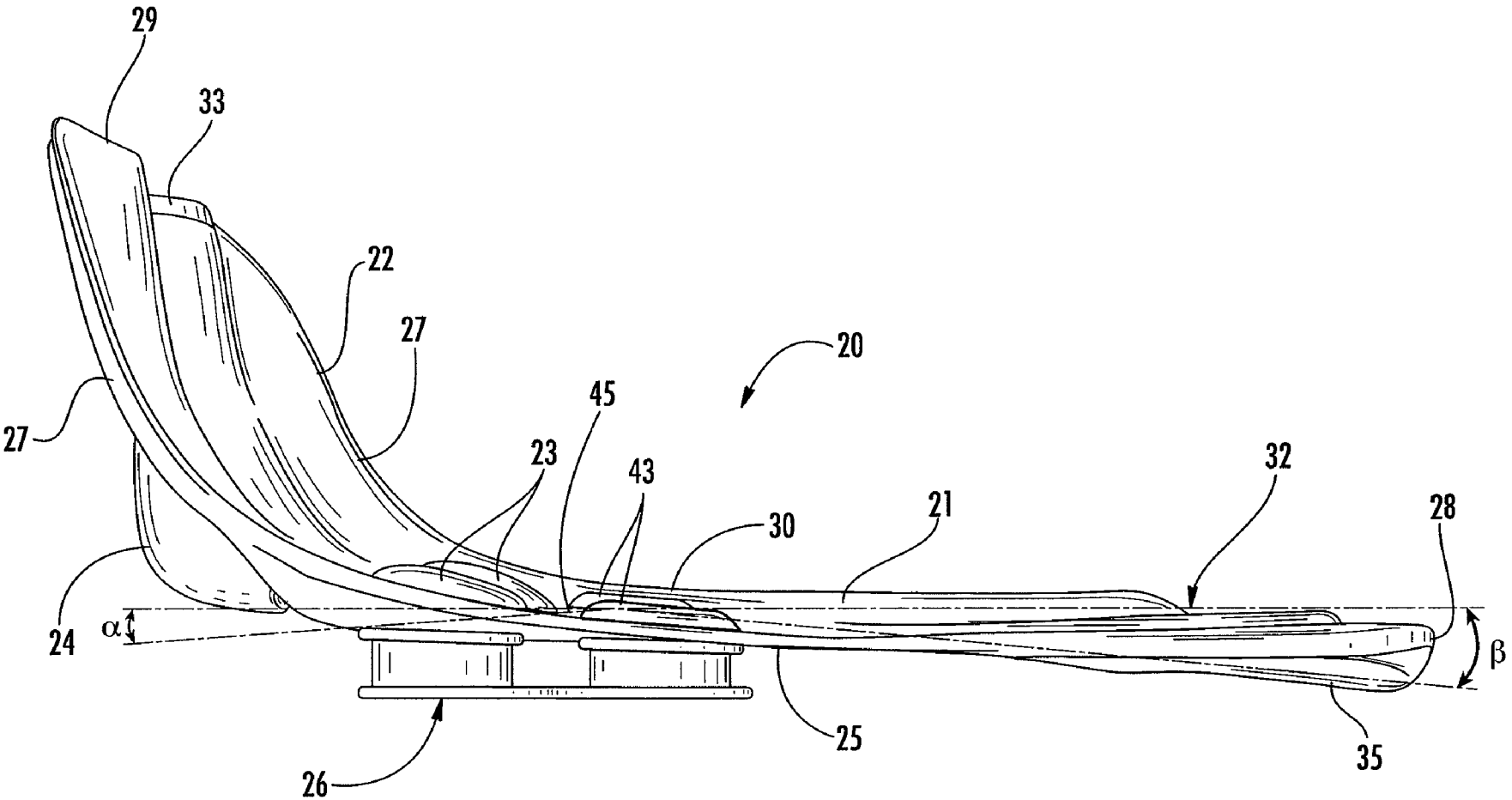
FIG. 2 is a side elevation view of the contoured seat of FIG. 1.

Referring again to FIG. 1, the contoured seat 20 of the illustrated embodiment is defined by the shaped sheet 25 supported by the shock absorber system 26. The shaped sheet includes a pair of lateral edges 27 and a front edge 28 and a top edge 29, as shown in FIG. 2. The edges 27, 28 and 29 of the shaped sheet 25 extend peripherally around a surface that can be divided into the seat surface 21 and the back surface 22. The seat surface 21 and the back surface 22 are themselves generally defined by the change in angle from near horizontal to near vertical illustrated by FIG. 2. It should be noted, however, that there is not necessarily a sharp dividing line between the seat and back surfaces 21, 22 due to the smooth, concave transition between the two surfaces. Therefore, the seat and back surfaces 21, 22 can overlap and need not be mutually exclusive.

Seat surface 21 is somewhat saddle shaped, and includes a pair of spaced apart buttock contours 45 and a pair of spaced apart thigh contours 32, the buttock contours 45 and thigh contours 32 extending in opposing directions from one another. Thigh contours 32 are concave shapes configured to fit the contour of the sitter's thighs so as to evenly distribute pressure with a buttocks; each thigh contour forms an angle $\chi$ of about 7.5° with an axis running from the back surface 22 to the front edge 28 of the sheet 25, this configuration increasing the comfort of a sitter. Generally, the seat surface 21 in the area of the thigh contours 32 has an inclination $\beta$ of about 7.50, and preferably of about between 5° and 10° or 5° and 15°, while seat surface 21 in the area of buttock contours 45 has an inclination $\alpha$ of about 4.5°. These angles are defined by the thickness of the sheet 25 and/or the dimensions and relative position of the shock absorber system 26, as shown in FIG. 2, and generally correspond to anatomical pelvic tilt and lumbar lordosis. In particular, in the illustrated embodiment the sheet 25 has a fairly uniform thickness. The shock absorber system 26 is positioned on the undersurface 35 of the sheet 25 proximate to the transition between the seat surface 21 and the back surface 22. When occupied by a sitter, a portion of undersurface 35 of sheet 25 in the area of front edge 28 contacts the surface supporting seat 20, and that contact point and the shock absorbers define the angle of inclination of the seat surface 21. Seat surface 21 of contoured seat 20 follows this angle of inclination until the point at which the sheet 25 turns relatively sharply upward to define the back surface 22.

As shown in FIGS. 3-6, the shock absorber system 26 includes four cylindrical shock absorbers 37 arranged in groups of two on two base structures 39. Shock absorbers are formed of a deformable, generally elastic material. Preferably, the material composing the shock absorbers has a density similar to that of human soft tissue to increase the comfort of sitting. An example of such a material is ethylene vinyl acetate closed cell foam. However, other varieties of shock absorbers are also possible, including those incorporating other materials, those incorporating materials of different density or behavior upon loading, or those utilizing different deformable structures, such as springs. A somewhat rigid disk 41 is optionally included on top of each shock absorber 37 to facilitate manufacturing and a desirable load distribution within the shock absorber 37.

It should be noted that the structure of the shock absorber system 26 may be varied and still provide the desired angular inclination of the sitter. For example, the shock absorber system 26 might be removable and exchangeable with other differently sized and angled shock absorber systems or bases. In a particular embodiment, the shock absorber system 26 can be selectively positioned under the seat 20 to adjust the angle of inclination. In yet another example, the shock absorber system 26, or a substituted base, may include adjustable components (e.g., cams, gears, levers, or pumps) that allow the sitter to adjust the height and/or lumbar inclination angle to accommodate the anatomical variation or preference of the sitter. The shock absorber system 26 may also be modified to include components for securing it to existing seating such as clips, fasteners, ties, etc.

The illustrated contoured seat 20 can be produced in several steps, by forming the sheet 25 as discussed above, and separately forming the shock absorber system 26, and then assembling the component parts. Contoured seat 20, including the shock absorber system 26 and sheet 25, can also be manufactured as a single unit of injection molded or rotationally molded plastic. This method might be preferred, for example, in cases where the shock absorbers are springs or other deformable structures formed of plastic.

Figure 3:
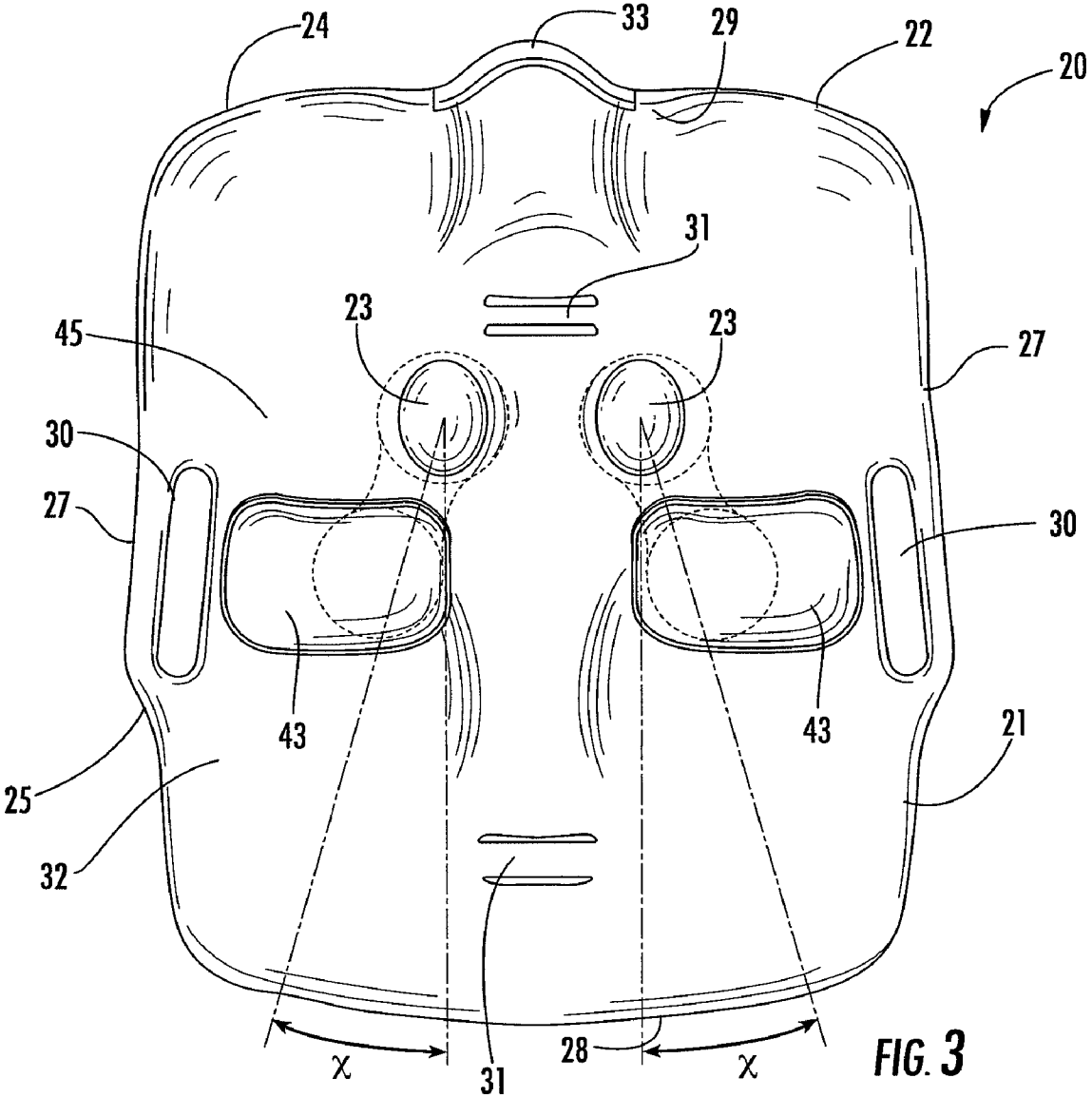
FIG. 3 is a top plan view of the contoured seat of FIG. 1.
Figure 4:
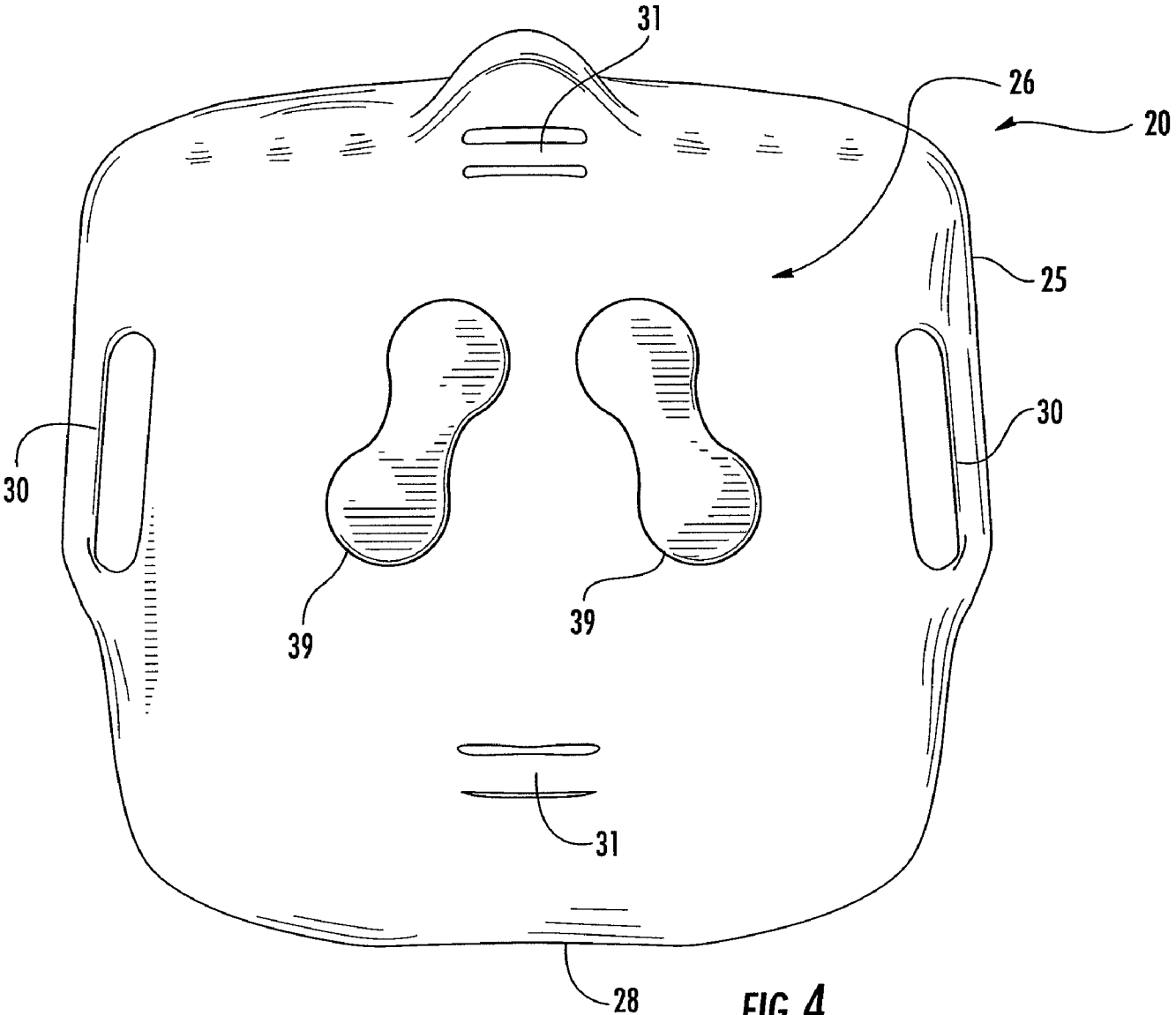
FIG. 4 is a bottom plan view of the contoured seat of FIG. 1.
Figure 5:
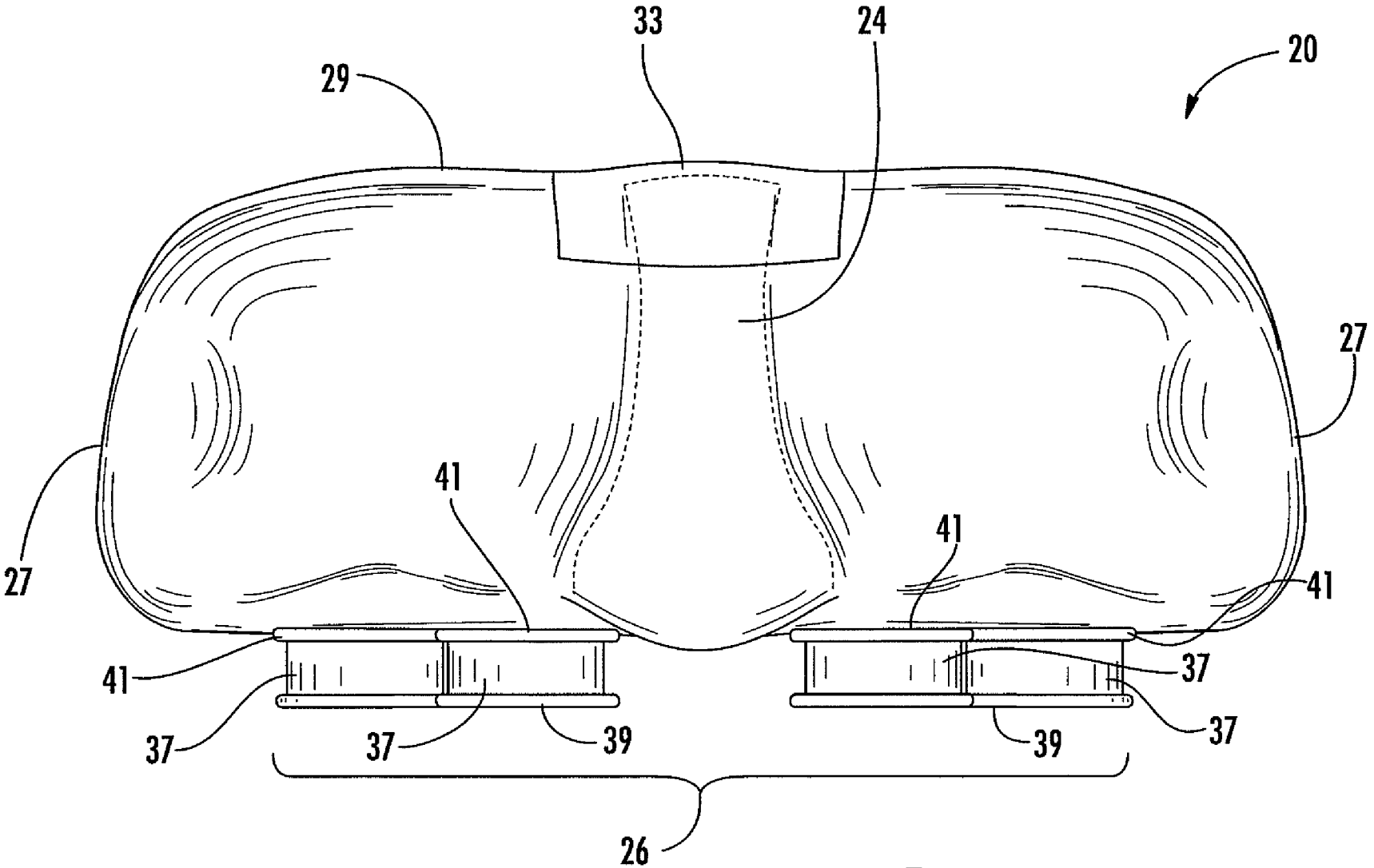
FIG. 5 is a rear elevation view of the contoured seat of FIG. 1.
Figure 6:
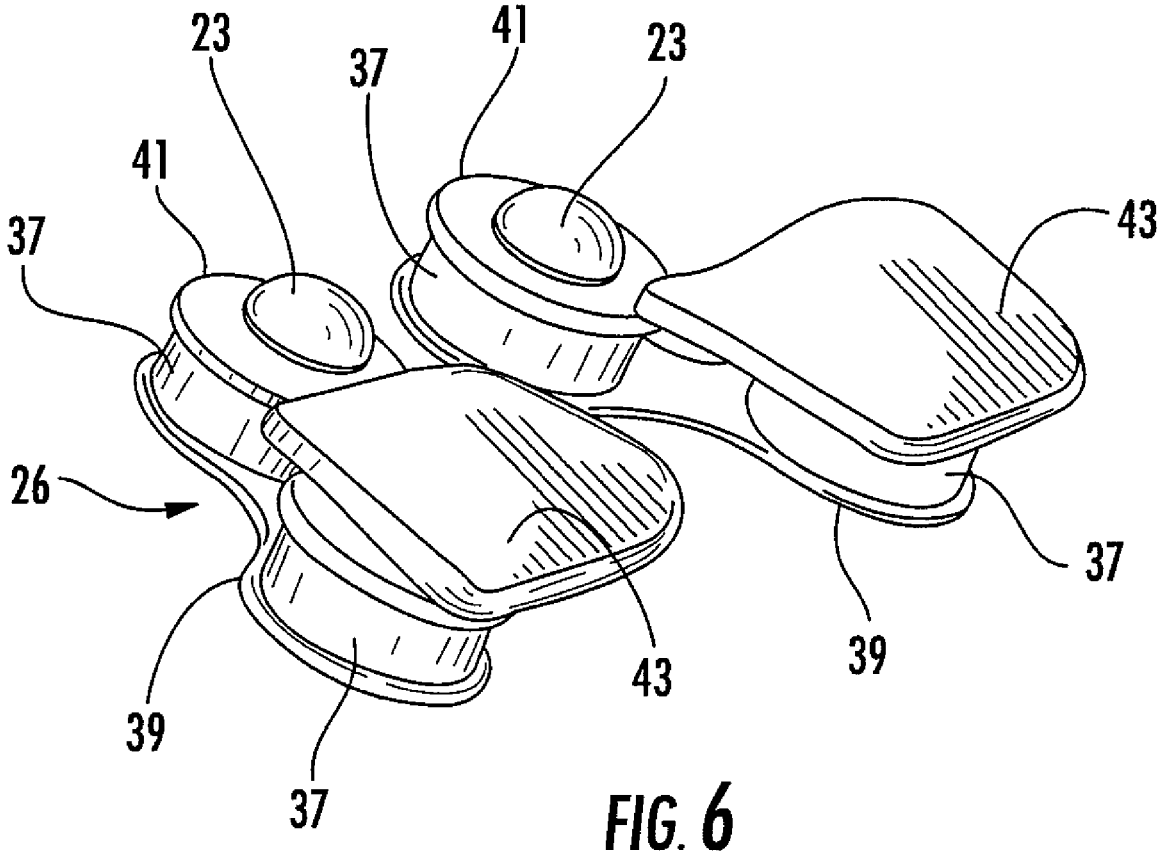
FIG. 6 is a perspective view of the contoured seat of FIG. 1, wherein the sheet has been removed to highlight the shock absorbers, muscle therapy knobs, and ischial cushions.

The seat surface 21 also has defined therein a pair of laterally extending securing crossbars 31, as shown in FIG. 3. Each of the crossbars is defined by a pair of parallel laterally extending slits extending through the sheet 25. These slits define the top and bottom edges of the crossbars and allow the passage of a strap or clamp, such as a strap with a hook-and-loop connector, for securing the seat 20 to an existing seat, bleacher, or other surface. Preferably, the crossbars are positioned symmetrically across a medial dividing line of the seating surface 21 at front and rear locations of the seat 20. In this manner, they fall between the base structures 39 of the shock absorber system 26 and provide for backward lean by the sitter on the seat 20 and into the back surface 22. These positions also avoid the straps impinging on the legs or other anatomy of the sitter.

Further defined in the seat surface 21 is a pair of handle openings 30. The handle openings are elongated openings having a long axis extending front to rear and along a respective one of the lateral edges 27. In this manner, a hand can be extended through the opening and a grip made around the lateral edge for carrying the contoured seat 20. Other types of handles could also be formed, attached or shaped in the seat 20, such as by attachment of an easy-gripping flange or use of the securing crossbar 31, and still be within the purview of the present invention. Handles may be padded to increase user comfort when gripping the handles. It should be noted, however, that the seat 20 may be produced without handles, and this configuration may be desired for some applications, such as semi-permanent use in an office setting.

Figure 7:
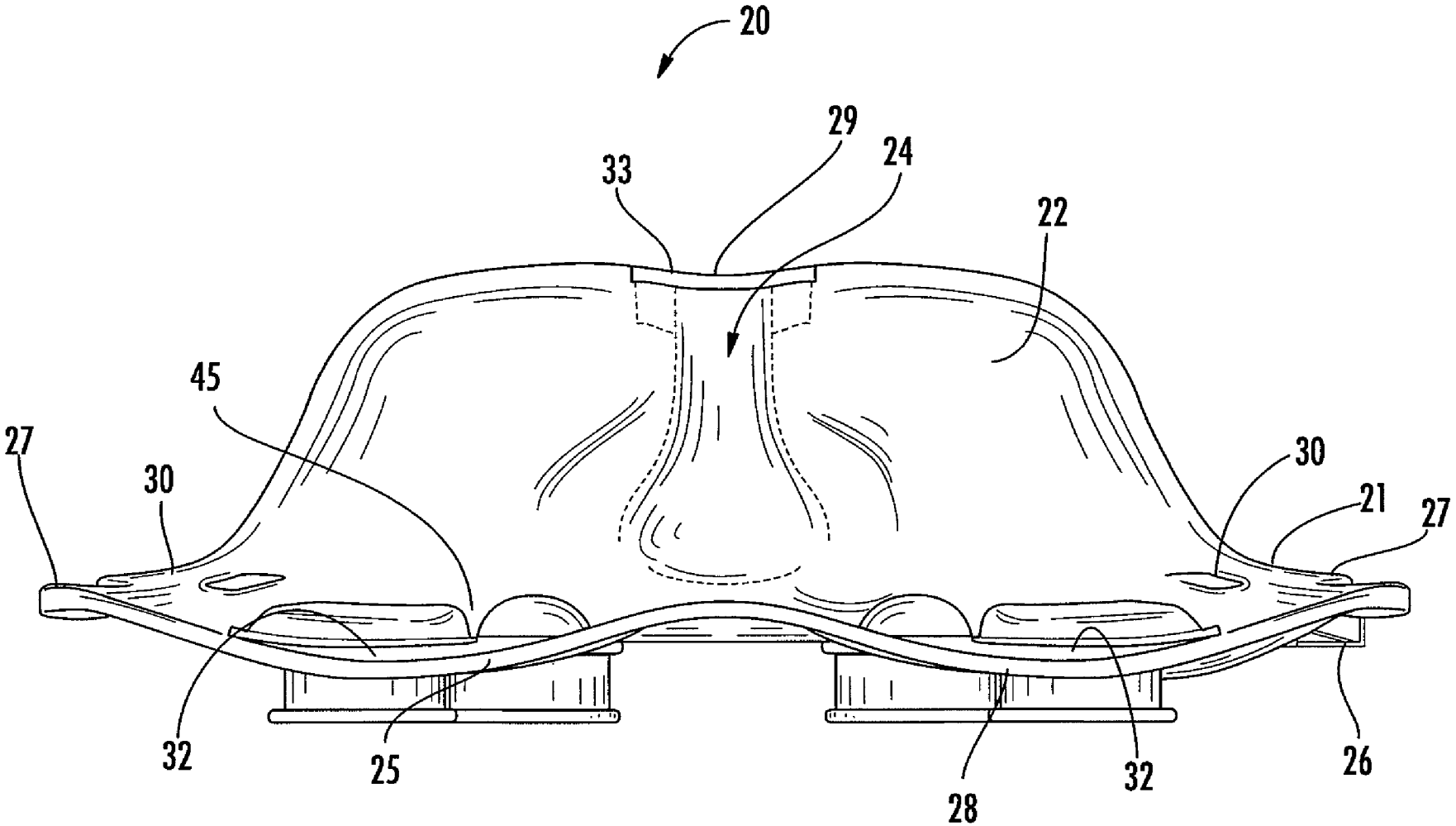
FIG. 7 is a front elevation view of the contoured seat of FIG. 1.

The piriformis supporting ovals 23 are also defined in the seat surface 21. As shown in FIG. 3, the ovals 23 have a long axis extending in a direction approximately aligned with the front-to-back axis of the seat surface 21, but angled slightly laterally at their anterior or front ends. A short axis of the supporting ovals 23 extends generally laterally with a small angle corresponding to the lateral orientation of the long axis. As shown in FIG. 7, the supporting ovals 23 incline as they extend rearwardly.

The supporting ovals 23 are positioned bilaterally (left and right) so as to apply pressure to the piriformis musculature when a user is seated on the seat 20. In particular, the supporting ovals 23 are preferably positioned between the greater trochanter, ischial tuberosities and the sacral apex, between which extends the piriformis musculature. With even more particularity, the location would be between the greater trochanter of the femur, the lateral lower edge of the sacral apex, and the ischial tuberosities. The primary purpose of the pressure points of the supporting ovals 23 is to relax the piriformis muscle. Therefore, pressure should generally be avoided on a bony region to avoid pressure points. A secondary purpose is to relax the surrounding soft tissues at this triangular space, such as other tendons, muscles, and ligaments. Ischium cushions 43 are also provided in the area of the thigh contours 32 and/or buttock contours 45 for enhanced comfort of a sitter.

The shock absorbers 37 are positioned such that they underlie the supporting ovals 23 and ischium cushions 43. This positioning has several advantages, including enhanced balancing of the spine and improved lateral tilt of posture, thereby affecting a proper pelvic tilt angle in the sitter. In addition, the shock absorbers 37 provide added cushioning when sitting and help to compensate for uneven supporting surfaces. It should be noted, however, that the configuration and placement of shock absorbers can vary from that shown in the present embodiment. For example, more or less than four shock absorbers can be employed, and placement of the shock absorbers can be tailored for a specific user or for specific applications.

As can be seen in FIGS. 1, 2 and 7, the supporting ovals 23 have a rounded shape around the edges and a plateau region in the middle. This shape can vary in height and curvature, however, being taller and more knob-like or shallower depending upon the degree of pressure and the material composition of the supporting ovals 23. In one example, knob-like supports may be modeled after a partial sphere of a golf-ball instead of a more plateau-like shape. Also, shapes other than ovals may be employed, although preferably the shapes have rounded edges and fit a relatively high proportion of space of the triangle formed by the greater trochanter of the femur, the lateral lower edge of the sacral apex, and the ischial tuberosities.

The diameter of supporting ovals 23 may vary depending on the contour of their arching outer surface and the material used in the ovals. For example, a gel-like material can be made in a circular arch and still be comfortable due to the displacement of material, but if a plastic or relatively stiff materials is used, a lower profile, plateau shape with rounded edges would be more comfortable. Generally, however, the diameter of the points will range in size from ½ of an inch to 3 inches in diameter.

As another option, the supporting ovals 23 may be height-adjustable, such as via air-filled bladders attached to a pump or by a more mechanical system. Preferably, the height will vary from approximately zero inches to one inch, as measured from the base of the supporting ovals 23. These height variations will also affect the contour that is most comfortable for the sitter, including generally a more circular arch for lower heights and a flatter center with rounded edges for higher heights.

Defined in the back surface 22 and the transition region between the seat surface 21 and the back surface is the deep sacrum and coccyx groove, cutout, or pocket 24, as shown in FIG. 1. The sacral-coccyx groove 24 starts above the base of the sacrum at the top of the back surface 22 and extends to just in front of the anterior portion of the ischial tuberosities. The sacral-coccyx groove 24 extends forward past the coccyx, which advantageously allows for an improper seated posture (e.g., slouching) while still imparting the benefits of the groove. The depth and width of the sacral-coccyx groove 24 vary along its proximal-distal path to allow for the sacral stabilization and supporting ovals 23 to apply pressure to the piriformis musculature. Generally, the depth of the sacral-coccyx groove 24 should be between ½ inch and up to 2 inches. Its width should vary in size from about 1½ inches to 3 inches. Preferably, the shape of the groove 24 flares outward and deepens as it extends in a distal direction to provide space for the coccyx. Advantageously, the depth of the sacral-coccyx groove removes pressure and tension from the sacrum and coccyx and yet still leaves enough room for support of the buttocks and gluteus region.

In addition to the improved shape, the sacral-coccyx groove 24 responds differently to loading when the user is seated. When the seat 20 is sat upon, the depth of the groove 24 causes the groove to deform and pinch the musculature around the lower spine and sacrum. This overall deformation is mediated at the top edge by a reinforcing ridge 33. The reinforcing ridge 33 is a thickened edge that holds the shape and elasticity of the contoured seat 20 despite the increased depth of the groove 24.

During use, the contoured seat 20 can be strapped down to an existing surface using straps extended through and tightened around the securing crossbars 31. The user then sits back into the seat surface 21 and against the back surface 22, wherein the supporting ovals 23 are positioned to extend into the piriformis musculature. Also, the thighs of the sitter are cupped in the thigh contours 32 and the coccyx and sacrum are positioned in the sacral-coccyx pocket 24. The flexibility around the pocket 24 pinches in on the lower back muscles around the lumbar spine. The lower back is pushed into lordosis by the back surface 22, while the inclined seating surface (the incline being caused by the dimensions of the sheet 25 and the shock absorber system 26) causes the pelvis to incline forward for anatomic pelvic tilt. It should be noted that, in some applications, such as placement of seat 20 on flat ground or a floor, there is no need for securing the seat with straps. As such, straps and crossbars 31 can be excluded from such embodiments.

The contoured seat 20 and method of the present invention has many advantages. The provision of specifically angled support surfaces (due to the angle of inclination of the surfaces 21, 22) aligns the pelvis and lumbar spine and reduces pressure on the sacrum and coccyx. Generally, these support surfaces 21, 22 ensure that the pelvis is positioned at about a 15° angle and that the lumbar lordosis is maintained at about a 60° angle. The piriformis supporting ovals apply pressure to the difficult to stretch piriformis musculature. Overall, these positions reduce muscle tension and strain and reverse the incorrect rearward pelvic tilt of conventional ergonomic seating systems. For example, the shapes defined by the seating surface 21 and back surface 22 reduce muscle tension in the lower back, as confirmed by testing conducted using surface dwelling EMG electrodes. In addition, x-ray testing reveals an increase in lordosis in the lumbar spine. These changes result in less fatigue and pain for the user.

Figure 8:
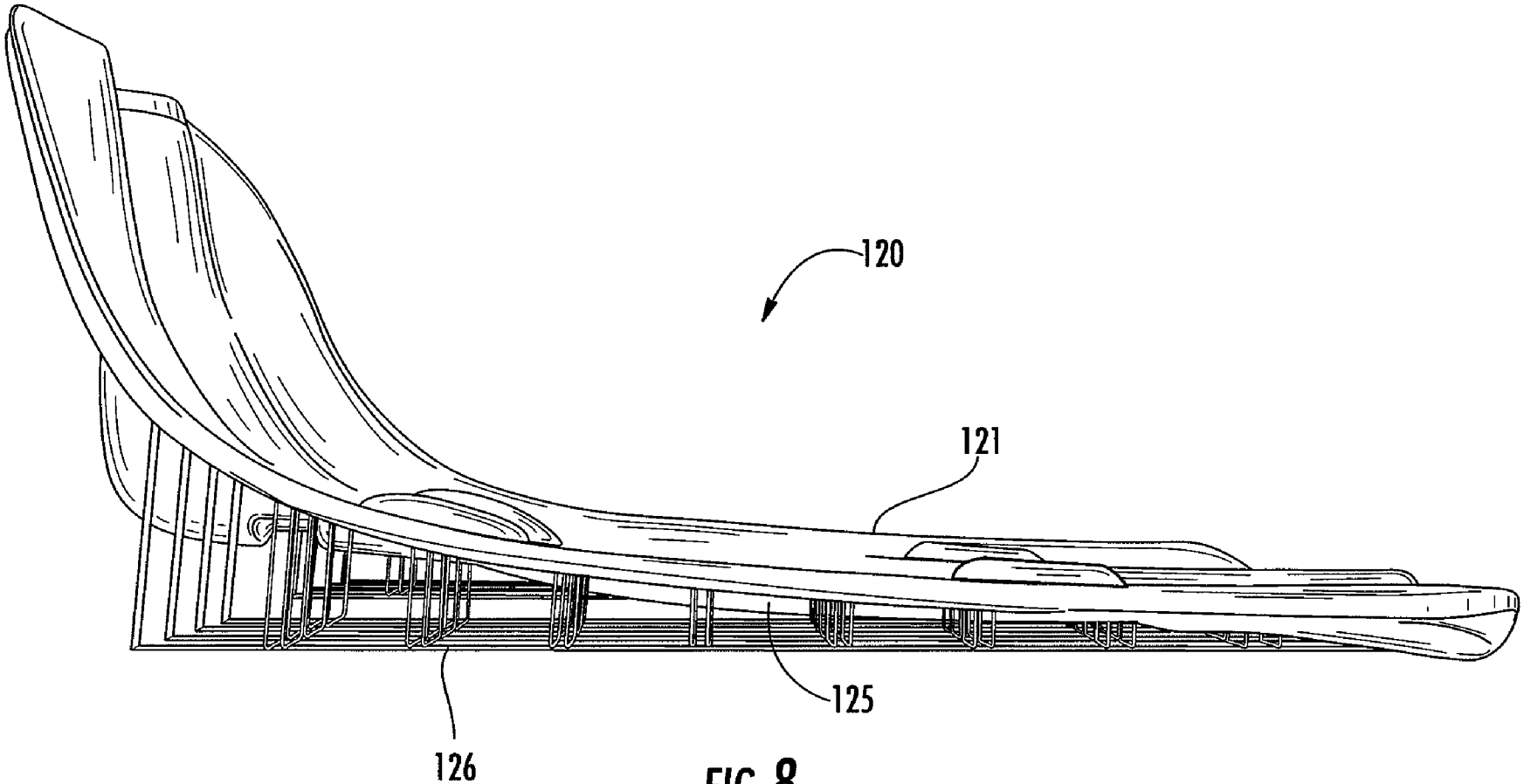
FIG. 8 is a perspective view of a contoured seat of another embodiment of the present invention in which a base is provided in place of shock absorbers.

Many modifications and other embodiments of the inventions set forth herein will come to mind to one skilled in the art to which these inventions pertain having the benefit of the teachings presented in the foregoing descriptions and the associated drawings. For example, in another embodiment shown in FIG. 8, contoured seat 120 includes sheet 125 supported by a base 126 that replaces the shock absorber system described earlier. The base is divided into two laterally separated grid structures, which provide for a light weight support structure for the rest of the seat 120. Preferably, the top edge of the grid structure of the base 126 is configured to follow the contour of the underside of the seat surface 121, but to be flat or straight on its bottom surface. This promotes use of the contoured seat 120 on normally flat or nearly flat surfaces while maintaining the desired degree of inclination. In other embodiments, the base 126 is a solid structure, or capable of detachment from the seat 120.

Figure 9:
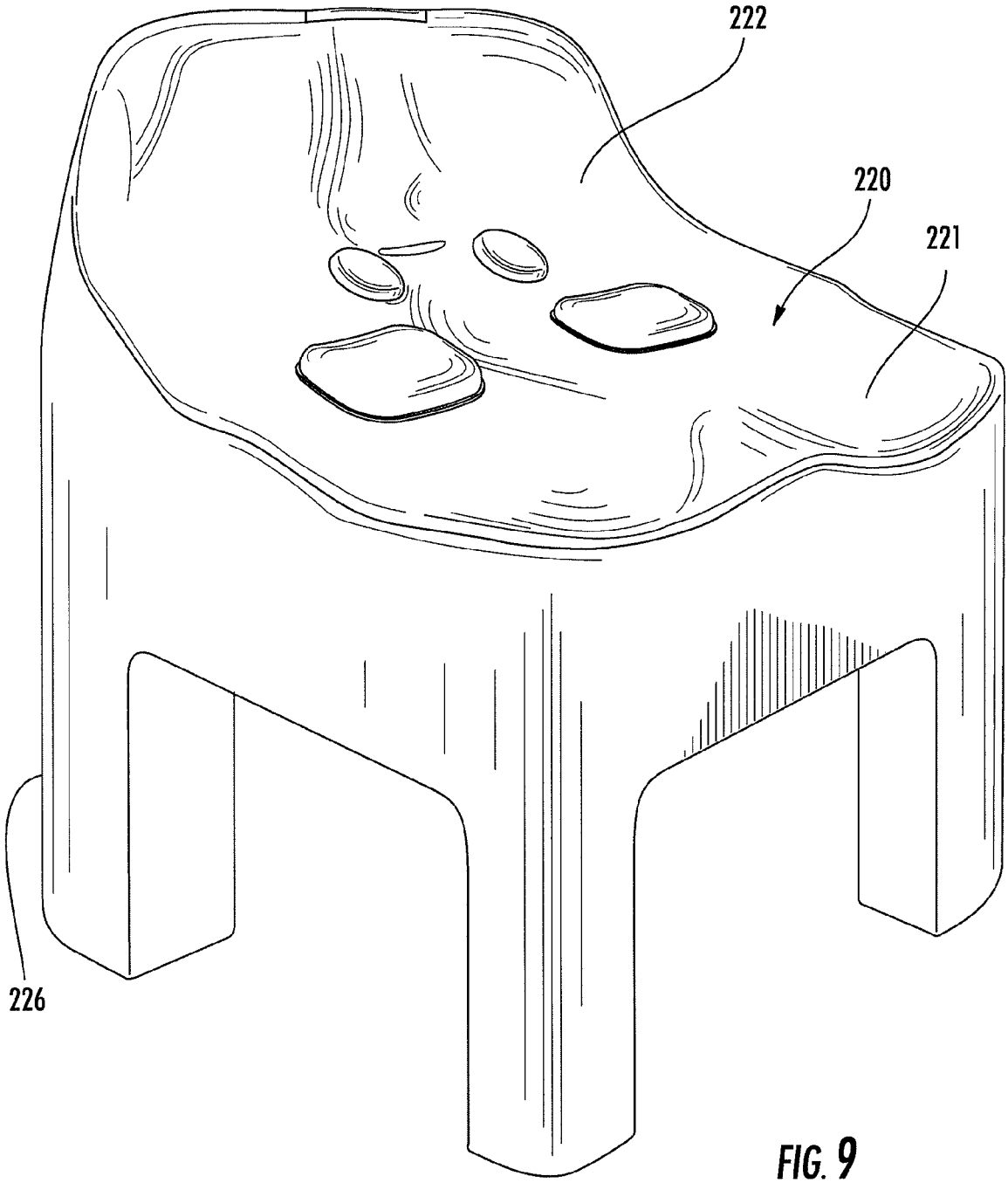
FIG. 9 is a perspective view of a contoured seat that is combined in a furniture seat.

Although the compact and portable aspects of the illustrated embodiments of the contoured seat 20, 120 of the present invention are advantageous, the contoured seat 20, 120 of the present invention may also stand on its own, such as by including legs or a supporting tripod. The contoured seat 20, 120 of the present invention may be attachable to or integrated within existing types of seating. For example, referring to FIG. 9, contoured seat 220 may stand on its own by having its surfaces 221 or 222 and/or other attributes combined in a recliner, automobile seat, stadium seat, furniture seat 226, etc. Also, while the piriformis supporting ovals have been described as inclining as they extend rearwardly, this is not always necessary, and some embodiments include horizontal, declined, or angled supporting ovals as application and user anatomy may dictate. The contoured seat of the present invention may include a heating and/or cooling system for use in indoor or outdoor, hot or cold environments. In still other embodiments of the present invention, the contoured seat has a removable SI joint orthotic and armrests attachable to the remainder of the seat via snaps or sockets. Sockets are included in the SI joint orthotic for the attachment of thickness adjustment pads to compensate for variations in user anatomy. Another embodiment includes a seat base accessory that compensates for curvature and softness of varying seats when the inventive contoured seat is placed upon them Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A contoured seating surface comprising:

a seat portion having a surface configured to extend along thighs of a sitter and including a pair of spaced protrusions extending upward from the surface at positions corresponding to piriformis muscles of the sitter, wherein the protrusions are configured to apply targeted pressure to the piriformis muscles of the sitter when sitting in said contoured seating surface; and a back portion extending distally from, and at an angle to, said seat portion, wherein the seat and back portions are included in a sheet of finite thickness formed of a stiff material, wherein the back portion is at least partially bounded by a distal edge located distally from the seat portion and defines a pocket configured to accommodate a sacrum and coccyx of the sitter, said pocket including a concave contour relative to a seated position of the sitter that defines a volume that remains substantially unoccupied, and wherein said back portion is configured to flex inward to laterally compress and support a lower back portion of the sitter when sitting in said contoured seating surface.

2. A contoured seating surface according to claim 1, wherein the protrusions extending upward from the surface of the seat portion are oval in shape.

3. A contoured seating surface according to claim 1, wherein the protrusions extending upward from the surface of the seat portion include a gel material.

4. A contoured seating surface according to claim 1, further comprising a support structure coupled to an underside of said seat portion, said support structure and said seat portion being configured to cause said seat and back portions to affect a pelvis angle of the sitter of about 15 degrees from horizontal and a lumbar lordosis angle of the sitter of about 60 degrees from vertical.

5. A contoured seating surface according to claim 1, wherein the pocket defined by said back portion has increasing width when moving in a direction from the distal edge towards the seat portion.

6. A contoured seating surface according to claim 1, wherein the distal edge has a thickness greater than that of the back portion defining the pocket.

7. A contoured seating surface according to claim 1, wherein said seat portion includes a pair of spaced ischium cushions extending upward from the surface at positions corresponding to the thighs of the sitter.

8. A contoured seating surface according to claim 1, further comprising a support structure coupled to an underside of said seat portion, said support structure and said seat portion being configured to cause the seat portion to assume an angle of inclination with respect to horizontal of between 5 and 10 degrees.

9. A contoured seating surface according to claim 1, further comprising a support structure coupled to an underside of said seat portion, said support structure and said seat portion being configured to cause the seat portion to assume an angle of inclination with respect to horizontal of about 7.5 degrees when occupied by the sitter.

10. A contoured seating surface according to claim 1, wherein the pocket is a cutout.

11. A contoured seating surface according to claim 1, wherein the seat portion includes at least one crossbar for securing one or more straps capable of securing said contoured seat to an existing surface.

12. A contoured seating surface according to claim 1, wherein the sheet is formed of a material selected from the group consisting of plastic, fiberglass, metal, or wood material.

13. A contoured seating surface comprising:

a sheet of finite thickness formed of a stiff material including:

a seat portion having a surface configured to extend along thighs of a sitter; and a back portion extending distally from, and at an angle to, the seat portion, the back portion being at least partially bounded by a distal edge located distally from the seat portion and defining a pocket configured to accommodate a sacrum and coccyx of the sitter, the pocket including a concave contour relative to a seated position of the sitter that defines a volume that remains substantially unoccupied and having increasing width when moving in direction from the distal edge towards the seat portion, and the distal edge having a thickness greater than that of the pocket; and a support structure coupled to an underside of said seat portion, said support structure and said seat portion configured to cause said seat and back portions to affect an anatomical position in the sitter, wherein the back portion is configured to flex inward to laterally compress and support a lower back portion of the sitter when sitting in said contoured seating surface, and wherein said support structure includes at least one shock absorber comprising a deformable material.

14. A contoured seating surface according to claim 13, wherein said support structure and seat portion are configured to cause said seat and back portions to affect a pelvis angle of the sitter of about 15° degrees from horizontal and a lumbar lordosis angle of the sitter of about 60 degrees from vertical.

15. A contoured seating surface according to claim 13, wherein the support structure, seat portion, and back portion are configured to cause the seat portion to assume an angle of inclination with respect to horizontal of between 5 and 10 degrees.

16. A contoured seating surface according to claim 13, wherein the support structure, seat portion, and back portion are configured to cause the seat portion to assume an angle of inclination with respect to horizontal of about 7.5 degrees when occupied by the sitter.

17. A contoured seating surface according to claim 13, wherein said seat portion includes a pair of buttock contours proximal to said back portion, the buttock contours being inclined at about 4.5 degrees off horizontal.

18. A contoured seating surface according to claim 13, further comprising a piece of furniture having a sitting portion capable of accommodating the sitter, and wherein said sheet is integrated into the sitting portion of said piece of furniture.

19. A contoured seating surface according to claim 13, wherein the support structure is adjustable.

20. A contoured seating surface according to claim 13, wherein the surface of the seat portion includes a pair of spaced protrusions extending upward from the surface at positions corresponding to piriformis muscles of the sitter, wherein the protrusions are configured to apply targeted pressure to the piriformis muscles of the sitter when sitting in said contoured seating surface.

21. A contoured seating surface according to claim 13, wherein the shock absorber comprises a deformable material with a density similar to that of human soft tissue.

22. A contoured seating surface according to claim 13, wherein said surface includes a pair of spaced ischium cushions extending upward from the surface at positions corresponding to the thighs of the sitter.

23. A contoured seating surface comprising:

a seat portion having a surface configured to extend along thighs of a sitter and including a pair of spaced protrusions extending upward from the surface at positions corresponding to piriformis muscles of the sitter, wherein the protrusions are configured to apply targeted pressure to the piriformis muscles of the sitter when sitting in said contoured seating surface; and a back portion extending distally from, and at an angle to, said seat portion, wherein the seat and back portions are included in a sheet of finite thickness formed of a stiff material, wherein the back portion is at least partially bounded by a distal edge located distally from the seat portion, and wherein said back portion is configured to flex inward to laterally compress and support a lower back portion of the sitter when sitting in said contoured seating surface.

24. A contoured seating surface according to claim 23, wherein the seating surface defines a pocket configured to accommodate a sacrum and coccyx of the sitter, said pocket including a concave contour relative to a seated position of the sitter.

25. A contoured seating surface according to claim 23, wherein the seating surface defines a cutout configured to accommodate a sacrum and coccyx of the sitter.

* * * * *

UNITED STATES PATENT AND TRADEMARK OFFICE

CERTIFICATE OF CORRECTION

PATENT NO. : 7,607,738 B2
APPLICATION NO. : 11/532143
DATED : October 27, 2009
INVENTOR(S) : Gregory et al.

It is certified that error appears in the above-identified patent and that said Letters Patent is hereby corrected as shown below:

Title page,

Item (57), line 5, ABSTRACT, "performs" should read --piriformis--.

Signed and Sealed this

Sixteenth Day of November, 2010

David J. Kappos

David J. Kappos
*Director of the United States Patent and Trademark Office*